US009711339B2

(12) United States Patent
Shimura et al.

(10) Patent No.: US 9,711,339 B2
(45) Date of Patent: Jul. 18, 2017

(54) METHOD TO GENERATE DATA ACQUISITION METHOD OF MASS SPECTROMETRY

(71) Applicant: Agilent Technologies, Inc., Santa Clara, CA (US)

(72) Inventors: Masaru Shimura, Tokyo (JP); Kazuo Yamanaka, Tokyo (JP)

(73) Assignee: Agilent Technologies Inc., Santa Clara, CA (US)

( * ) Notice: Subject to any disclaimer, the term of this patent is extended or adjusted under 35 U.S.C. 154(b) by 7 days.

(21) Appl. No.: 14/572,196

(22) Filed: Dec. 16, 2014

(65) Prior Publication Data

US 2015/0187556 A1 Jul. 2, 2015

(30) Foreign Application Priority Data

Dec. 27, 2013 (JP) ..... 2013-273545

(51) Int. Cl.
*H01J 49/00* (2006.01)
*H01J 49/10* (2006.01)

(52) U.S. Cl.
CPC ..... *H01J 49/105* (2013.01); *H01J 49/0009* (2013.01); *H01J 49/0031* (2013.01)

(58) Field of Classification Search
None
See application file for complete search history.

(56) References Cited

U.S. PATENT DOCUMENTS 7,671,329 B2 * 3/2010 Sakata ..... H01J 49/105 250/281
7,869,968 B2 * 1/2011 Sakata ..... H05H 1/30 250/281
2005/0218319 A1 * 10/2005 Bandura ..... G01N 15/1404 250/288

FOREIGN PATENT DOCUMENTS

JP 4822346 11/2011
JP 4822346 B2 * 11/2011 ..... H05H 1/30
(Continued)

OTHER PUBLICATIONS

Hewitt, Elizabeth F. et al., "Implementation of a rapid and automated high performance liquid chromatography method development strategy for pharmaceutical drug candidates", Journal of Chromatography A, 1107 (2006) 79-87.
(Continued)

*Primary Examiner* — Andrew Smyth

(57) ABSTRACT

A process for automatically creating a measurement method suitable for plasma ion source mass spectrometry, including: semi-quantitatively measuring all elements in the sample that affect the measurement; determining a plasma condition based on the total concentration of the semi-quantitatively measured elements; for each of the semi-quantitatively measured elements, estimating signal strengths of the element and an interference component in the sample to be measured and based on the resultant estimates, estimating the concentration of the element; and, based on the estimated signal strengths of the elements and the interference components and the estimated concentrations of the elements, creating at least one mass spectrometry method including at least one of: (1) a plasma condition; (2) an internal standard to be added to the sample; (3) a tuning condition for the collision/reaction cell; (4) a mass-to-charge ratio used in the
(Continued)

mass spectrometer; and (5) an integration time used in the mass spectrometer.

20 Claims, 5 Drawing Sheets

(56) References Cited

FOREIGN PATENT DOCUMENTS

| | | | |
|---|---|---|---|
| JP | 4903515 | 3/2012 | |
| JP | 4903515 B2 * | 3/2012 | ..... H01J 49/105 |

OTHER PUBLICATIONS

Agilent ICP-MS Journal; Agilent Technologies; Issue 31; Jun. 2007.
Thomas, Robert; Practical Guide to ICP-MS: A Tutorial for Beginners, Second Edition; Practical Spectroscopy series vol. 37; 2008; pp. 118.

* cited by examiner

FIG. 7

| Element | Mass number | Semi-quantitative conc. | Unit | CPS |
|---|---|---|---|---|
| Li | 7 | 0.065974892 | ppm | 1,170.0 |
| Be | 9 | 0.026581489 | ppm | 1,120.0 |
| B | 11 | 0.333197107 | ppm | 4,440.5 |
| C | 12 | 21.235864333 | ppm | 61,809.4 |
| [illegible] | [illegible] | [illegible]427619 | ppm | 1,362,227.1 |
| [illegible] | [illegible] | [illegible] | [illegible] | [illegible] |
| Au | 197 | [illegible] | [illegible] | [illegible] |
| Hg | 202 | 0.000006866 | ppm | [illegible] |
| Tl | 205 | 0.006814349 | ppm | 407,750.3 |
| Pb | 208 | 0.018804081 | ppm | 775,384.4 |
| Bi | 209 | 0.013698305 | ppm | 808,211.4 |
| Th | 232 | 0.000020563 | ppm | 1,690.1 |
| U | 238 | 0.000002594 | ppm | 220.0 |

METHOD TO GENERATE DATA ACQUISITION METHOD OF MASS SPECTROMETRY

RELATED APPLICATIONS

This application claims the benefit under 35 U.S.C. 119 of Japanese Patent Application No. 2013-273545, filed Dec. 27, 2013, titled "PROCESS FOR AUTOMATICALLY CREATING MASS SPECTROMETRY METHOD," the content of which is incorporated by reference herein in its entirety.

TECHNICAL FIELD

The present invention relates to a process for automatically creating a mass spectrometry method in a plasma ion source mass spectrometry apparatus, in particular a process for automatically creating a mass spectrometry method suitable for an analyte sample when a plasma ion source mass spectrometry apparatus such as an ICP (inductively coupled plasma) mass spectrometer is used for measurement. The process of the present invention can be implemented by following a computer program.

BACKGROUND

Mass spectrometry using a plasma ion source, for example, ICP mass spectrometry is useful in analyzing inorganic elements, especially a trace amount of metal, and is widely used in many fields including semiconductor, geological and environmental industries. ICP mass spectrometry enables substantial and simultaneous multi-element analysis on most elements in the periodic table, and the concentration of an element can be quantitated with an excellent level of sensitivity in the order of one billionth (ppb) or one trillionth (ppt).

An ICP mass spectrometry apparatus uses inductively-coupled argon plasma as an ionization source; and ions of analyte elements generated by the plasma are introduced as a beam into a mass spectrometer; and separated and measured depending on the mass-to-charge ratio (m/z). That is, analyte elements are dissolved in a sample solution and sent to a nebulizer to generate a sample aerosol by a pump together with elements added as an internal standard. The sample aerosol is supplied to plasma, and, then, desolvated, atomized and ionized. The resultantly obtained element ions are conveyed from the plasma to the mass spectrometer through an interface and an ion lens having two orifices known as a sampling cone and a skimmer cone. However, in many cases, in order to eliminate the influence of interference ions, a collision/reaction cell is arranged subsequent to the ion lens. The collision/reaction cell introduces thereinto a reactive gas with a relatively small molecular weight such as hydrogen or an inert gas such as helium to selectively neutralize polyatomic molecule ions in the introduced ion beam by reaction with gas molecules or to cause the loss of kinetic energy by collision, thereby preventing the interference to measured signals.

In the meantime, for conducting actual measurement by use of an ICP mass spectrometry apparatus, it is necessary to set the time for sample uptake/rinse, selection of internal standard elements to be used, a plasma condition, a gas condition for a collision/reaction cell, and an integration time in a mass spectrometer and to create/determine an analytical method suitable for the sample. Of conventional measurement method creations for ICP mass spectrometry apparatus, there is a method wherein a user selects from preset methods created for preliminarily expected conditions. This method is convenient for a sample, from which an object to be measured is easily expected, like measurement pertaining to laws and regulations, such as the quality of tap water, but it is necessary for a user to optimize conditions in the case of a sample outside the conditions of the preset methods. Further, in the case of: a sample for which it is difficult to select a plasma condition or a gas flow rate due to the influence of co-existing matrix; an unknown sample to which whether existing methods are applicable or not is unclear; and a sample, for each lot of which a different method is preferably used, a measurement method with an appropriate condition is conventionally determined by a user based on a plurality of measurement results. However, this may be largely dependent on experience and intuition of a user and is a complicated work that requires time and effort.

Patent Document 1 (Japanese Patent No. 4,903,515) discloses a technique for automatically determining by a computer program conditions such as the flow rate of carrier gas in an aerosol and the RF output of plasma using the relationship in sensitivity between a specific metal ion and oxide ions of the metal ion. This is suitable for optimizing a plasma condition in response to, especially a high matrix sample, but is unable to automatically create a mass spectrometry method over the entirety of an ICP mass spectrometry apparatus. Further, Patent Document 2 (Japanese Patent No. 4,822,346) discloses a system for diagnosing and correcting apparatus characteristics of an ICP mass spectrometry apparatus. However, this also mainly relates to the calibration of parameters pertaining to plasma, and is not able to automatically create a mass spectrometry method over the entirety of an ICP mass spectrometry apparatus.

Non-patent Document 1 (E. F. Hewitt, P. Lukulay, and S. Galushoko, "Implementation of a rapid and automated high performance liquid chromatography method development strategy for pharmaceutical drug candidates," J, Chromatgr, A, 1107, 79-87, 2006) describes automatically creating a measurement method suitable for an analyte sample by a computer though it relates to liquid chromatography. However, this method conducts modeling of a retention time of chromatography and creates a measurement method in an off-line mode. Thus, it cannot be used for an ICP mass spectrometry apparatus of a different measuring method.

SUMMARY

To address the foregoing problems, in whole or in part, and/or other problems that may have been observed by persons skilled in the art, the present disclosure provides methods, processes, systems, apparatus, instruments, and/or devices, as described by way of example in implementations set forth below.

As described above, several algorithms have been conventionally developed to enhance the performance of ICP mass spectrometry apparatuses. However, there has been no method for automatically creating a mass spectrometry method of a user over the entirety of ICP mass spectrometry. An object of the present invention is to provide a method, which enables automatic creation of a measurement method suitable for ICP mass spectrometry on an element to be measured or mass spectrometry using other plasma ion sources regardless of whether a sample is known or unknown.

The present invention provides a process for automatically creating a mass spectrometry method in a plasma ion source mass spectrometry apparatus, which supplies a sample to be measured to plasma to ionize elements in the sample; introduces a beam of generated ions into a mass spectrometer through a collision/reaction cell; and separates and detects ionized elements depending on the mass-to-charge ratio. This method includes:

semi-quantitatively measuring at least all elements in the sample that affect the setting of measurement conditions;

determining a plasma condition based on the total concentration of the semi-quantitatively measured elements;

for each of the semi-quantitatively measured elements, estimating signal strengths of the elements and interference components in the sample to be measured and, based on the resultant estimates, estimating the concentrations of the elements; and based on the estimated signal strengths of the elements and interference components and the estimated concentrations of the elements, creating at least one mass spectrometry method including at least one of:

(1) a plasma condition;

(2) a combination of internal standard elements to be used for correction at the time of quantitating an element to be measured;

(3) a tuning condition for the collision/reaction cell;

(4) a mass-to-charge ratio used in a mass spectrometer; and (5) an integration time used in the mass spectrometer.

Next, the method enables a user to quantitate the sample to be measured based on the created at least one mass spectrometry method.

Further, according to another aspect of the present invention, an uptake time of the sample to be measured from a vial to the plasma or a time for washing an introduction path with a rinse liquid is estimated prior to semi-quantitatively measuring the all elements in the sample to be measured. This may be carried out by switching from a blank liquid introduction state to a liquid such as a standard liquid to introduce into an ICP mass spectrometry apparatus and measure a detection signal; differentiating the measured value to detect an extreme value of a gradient; and thereafter, detecting when the gradient approaches zero. In this case, not only a liquid sample but also a gaseous sample may be used as a sample to be introduced.

Further, the present invention can be implemented as a program enabling a computer to execute the above process. For example, a computer program is typically used to operate a plasma ion source mass spectrometry apparatus, which supplies a sample to be measured to plasma to ionize elements in the sample; introduces a beam of generated ions into a mass spectrometer through a collision/reaction cell; and separates and detects ionized elements depending on the mass-to-charge ratio. This computer program is implemented as a program for automatically creating a mass spectrometry method, which enables a computer to execute:

a procedure for semi-quantitatively measuring all elements in the sample to be measured that affect the setting of measurement conditions, using the plasma ion source mass spectrometry apparatus;

a procedure for determining a plasma condition based on the total concentration of the semi-quantitatively measured elements;

a procedure for estimating, for each of the semi-quantitatively measured elements, signal strengths of the elements and interference components in the sample to be measured and, based on the resultant estimates, estimating the concentrations of the elements; and a procedure for, based on the estimated signal strengths of the elements and the interference components and the estimated element concentration, creating at least one mass spectrometry method including at least one of:

(1) a plasma condition;

(2) a combination of internal standard elements to be used for correction at the time of quantitating an element to be measured;

(3) a tuning condition for the collision/reaction cell;

(4) a mass-to-charge ratio used in a mass spectrometer; and (5) an integration time used in the mass spectrometer.

According to an embodiment of the program prior to semi-quantitatively measuring all elements in the sample, the program enables the computer to execute a procedure for introducing a liquid sample or a gaseous sample into the plasma ion source mass spectrometry apparatus and measuring a detection signal, and a procedure for differentiating the measured value to detect an extreme value of the gradient and thereafter detecting when the gradient approaches 0, thereby estimating an uptake time of the sample to the plasma and/or a washing time of the introduction path with a rinse liquid.

In some embodiments, the plasma ion source mass spectrometry apparatus is an ICP mass spectrometry apparatus.

According to another embodiment, a mass spectrometry process for quantitating an analyte element in a sample to be measured in a plasma ion source mass spectrometry apparatus is provided, which is based on at least one mass spectrometry method determined by the process according to any of embodiments disclosed herein.

The present invention allows the same calculation to be applicable to plasma ion source mass spectrometry apparatuses other than an ICP mass spectrometer apparatus, such as mass spectrometry apparatuses using MIP (microwave induced plasma) and GD (glow discharge) by replacing plasma conditions, tuning conditions, generation ratios of each interference component, priority order of tuning conditions, priority order of mass-to-charge ratios, semi-quantitative coefficients or others, as long as such apparatuses ionize elements in a sample by a plasma ion source and conduct mass measurement.

ADVANTAGES OF THE INVENTION

According to the present invention, estimate values induced from results of semi-quantitative measurement are used for determining an internal standard, a mass-to-charge ratio, a tuning condition, an integration time or the like used in a mass spectrometry method suitable for a sample to be measured; and no measurement for determination of these conditions is not carried out. Therefore, it is not necessary to conduct repeated measurements for these measurement conditions, and an appropriate mass spectrometry method can be automatically created within a short period. Further, a plurality of mass spectrometry methods suitable for a sample to be measured can be created, and a user can use two or more of them as a material to determine the probability on quantitative values. That is, the present invention is advantageous in estimating a signal of an element to be measured and a signal of an interference component in all expected modes for a collision/reaction cell from one spectrum measurement result, and based on that, determining subsequent processes without repeating any actual measurement.

Other devices, apparatus, systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims.

BRIEF DESCRIPTION OF THE DRAWINGS

The invention can be better understood by referring to the following figures. The components in the figures are not necessarily to scale, emphasis instead being placed upon illustrating the principles of the invention. In the figures, like reference numerals designate corresponding parts throughout the different views.

FIG. 7 illustrates TABLE 1, which schematically shows one example wherein a total of semi-quantitative concentrations is obtained based on the semi-quantitative results.

DETAILED DESCRIPTION

Figure 1:
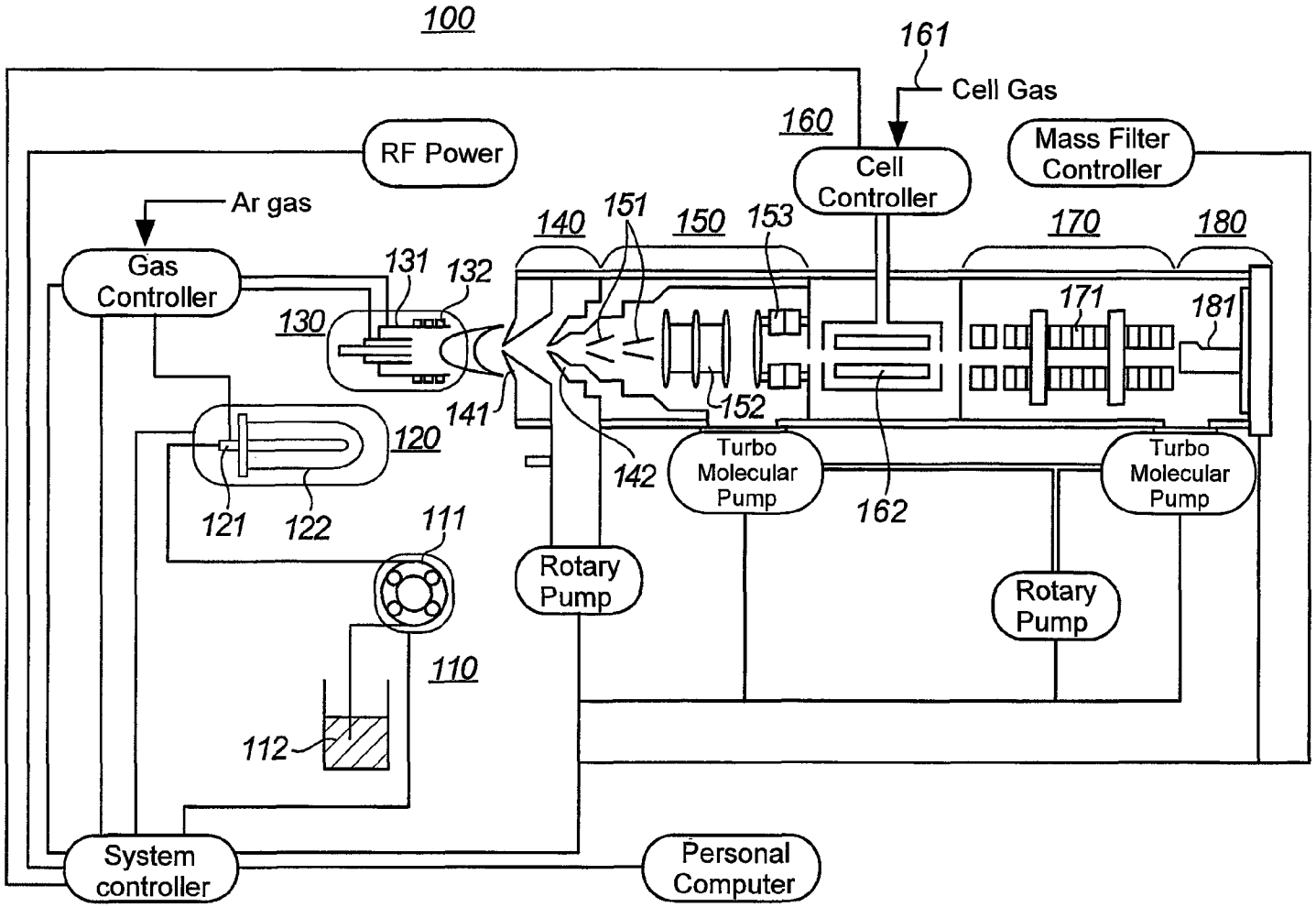
FIG. 1 is a schematic view of a typical ICP mass spectrometry apparatus, to which a process for automatically creating a mass spectrometry method of the present application is applied.

An ICP mass spectrometry apparatus 100 shown in FIG. 1 has an inductively-coupled plasma ion source 130, an interface 140 for extracting element ions generated from the sample from the plasma, an ion lens 150 for accelerating and sending the extracted ions as an ion beam, a collision/reaction cell 160 placed behind the ion lens; and a mass filter 170 and a detector 180 for separating the element ions based on the mass.

In a sample uptake section 110, a sample 112 in a vial is absorbed by a peristaltic pump 111 and sent to a nebulizer 121 projecting from an end of a temperature-controlled spray chamber 122 provided to a sample introduction section 120. A plurality of vials can be provided to the sample uptake section 110, and each of them contains a sample to be measured, various standard solutions, a tuning liquid, a calibration liquid, a rinse liquid or the like while they can be automatically switched. The nebulizer 121 nebulizes using a high-pressure argon (Ar) gas to form a sample aerosol. This aerosol is passed through the spray chamber 122, which removes large droplets, and then is blown into an ion source 130.

The ion source 130 has an ICP torch 131 and this torch is composed of a series of concentric quartz tubes, through which Ar gas flows. These quartz tubes are disposed within a high frequency (RF) coil 132. A high frequency magnetic field generated by this coil excites Ar atoms passing through the torch, enabling high-energy plasma to be generated and maintained. The sample aerosol is blown into the plasma, where it is desolvated, atomized and ionized.

In the interface 140, ions are extracted from the plasma through a sampling cone 141 and a skimmer cone 142, and accelerated by the ion lens 150 and sent as an ion beam to the collision/reaction cell 160 of a subsequent stage. The ion lens 150 may be provided with an extraction electrode 151, a series of focusing lenses 152 and an omega lens 153 mounted off-axis. As shown by reference numeral 161, gas may be introduced into the collision/reaction cell 160. A cell of this type is publicly known, and removes polyatomic molecule ions, which: contain elements derived from the introduced ion beam, from carrier gas or plasma gas, and further from auxiliary gas; and may cause interference to mass spectra, by generating a charge-transfer reaction caused by collision with gas molecules a reduction of motion energy or the like. Further, the cell 160 may contain a multipolar electrode or the like such as a quadrupole mass filter 162.

At a subsequent stage of the collision/reaction cell, the mass filter 170 and the detector 180 are placed. The mass filter 170 has a quadrupole mass filter 171 formed of, exemplarily, four parallel rods, and a high frequency voltage and a DC voltage are applied to these rods. In reaction to an arbitrary combination of applied high-frequency voltage and DC voltage, the mass filter allows only ions with a specific mass-to-charge ratio to pass through to the detector 180. This enables the detector 180 to separate and measure the specific ions from ions of different elements. The detector 180 includes an electron multiplier detector 181 disposed directly after the mass filter 171. An ion signal of each mass is amplified and then measured using a multi-channel counting device. The signal intensity at a given mass (and therefore element) is directly proportional to the concentration of that element in the sample solution.

All of the sample uptake section 110, the sample introduction section 120, the inductively-coupled plasma ion source 130, the collision/reaction cell 160, the mass filter 170 and the like are controllable by a system controller of the ICP mass spectrometry apparatus, and the system controller is controlled by a computer such as a personal computer. The method of the present invention can be implemented as a program executed by this computer, and thereby, a mass spectrometry method suitable for use in the ICP mass spectrometry apparatus 100 can be automatically determined depending on the sample to be measured.

Determination of Sample Uptake Time

According to the present invention, measurement necessary for automatic creation of a mass spectrometry method is conducted. Prior to that, measurement for obtaining the time to introduce the sample 112 into the plasma; or the rinse time necessary when the sample 112 is replaced with a rinse liquid and washing operation is conducted, can be made. Conventionally, the time of sample uptake is obtained, for example, by calculating a transitional time between lower limit and upper limit stable signal levels of detection signals obtained by measurement using some sort of a standard solution. However, in this case, such a long waiting time that permits a determination on whether the signal level is stable or not is necessary, and a long period of measurement time is required.

Figure 2:
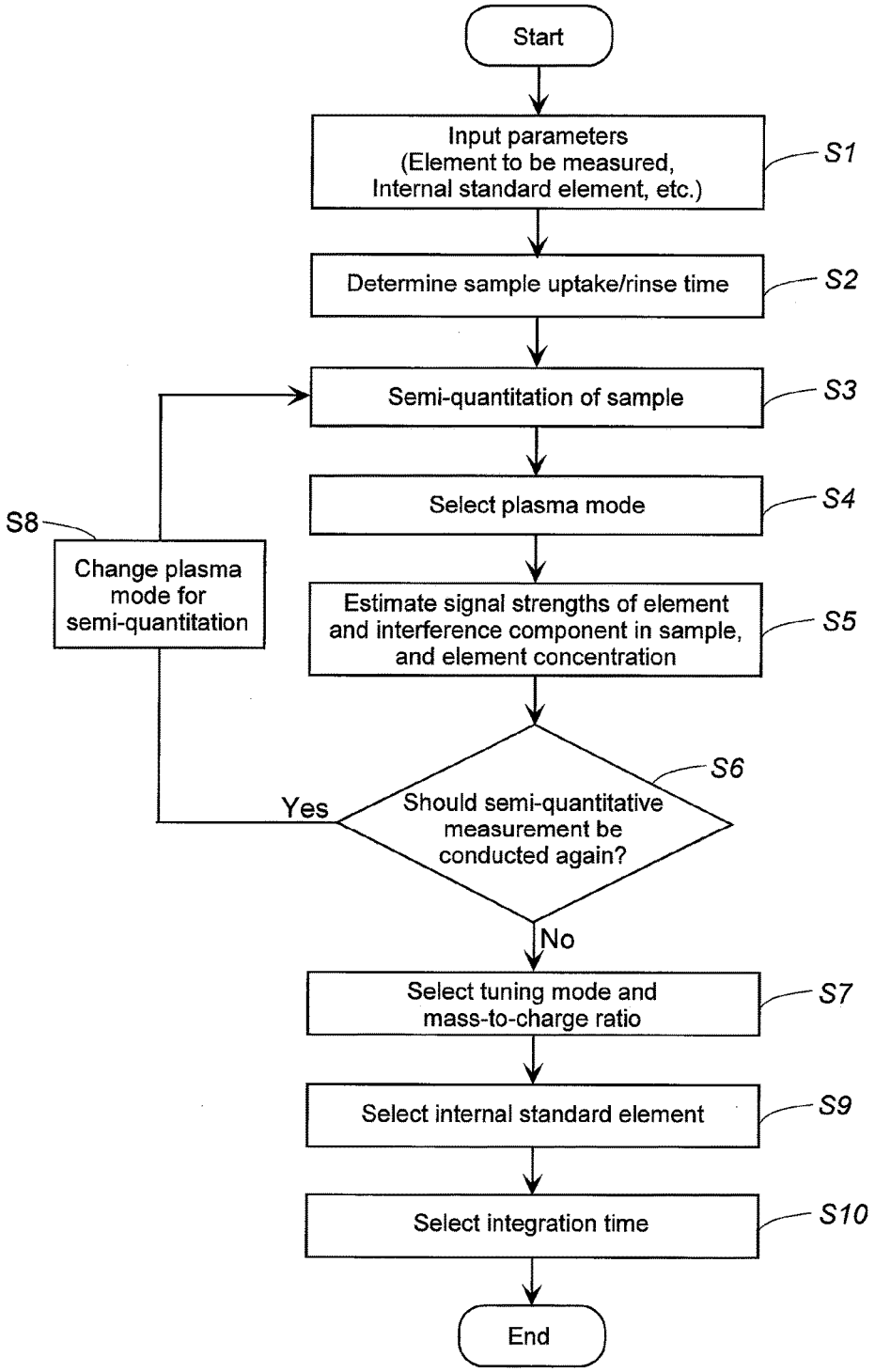
FIG. 2 is a flow chart showing one example of a flow of the method of the present invention.

The present invention can estimate an uptake time and a rinse time by measuring a detection signal after a liquid sample or a gas sample is introduced into an ICP mass spectrometry apparatus, differentiating a measurement value and detecting an extreme value of a gradient, and detecting that the gradient approaches 0. According to one embodiment, a blank liquid and a standard liquid are used and the measurement is conducted using the simplest method. Noises are removed by moving-average of the obtained measurement value, and then calculation is conducted. The measurement value after noise removal is differentiated to calculate a gradient, and the timing when the gradient goes by an extreme value and approaches 0 is obtained, and the time from sample introduction to this timing is taken as the uptake time (replacement time). Here, the gradient approaching 0 is the timing when the gradient has zero crossing or when the absolute value of the gradient is within the range of e.g., 15% or less of the absolute value of the extreme value. However, this value may be set within a range of, for example, 10% or less, or 5% or less, such that a time required to obtain a result is not too long. The rinse time may be obtained in the same manner. However, as another method, the same measurement is conducted using a rinse liquid, moving-average of a measurement value is differentiated to calculate a gradient, and a value that allows a moving average value to become maximum before a minimal point of the gradient is obtained. A time period from the introduction of the rinse liquid to the reduction of a moving average signal to a predetermined ratio of this value may be obtained as the rinse time. The obtained uptake time and rinse time are stored in a computer memory, and may be used for subsequent operations. In the exemplary flow chart shown in FIG. 2, this step is indicated as S2.

Figure 3:
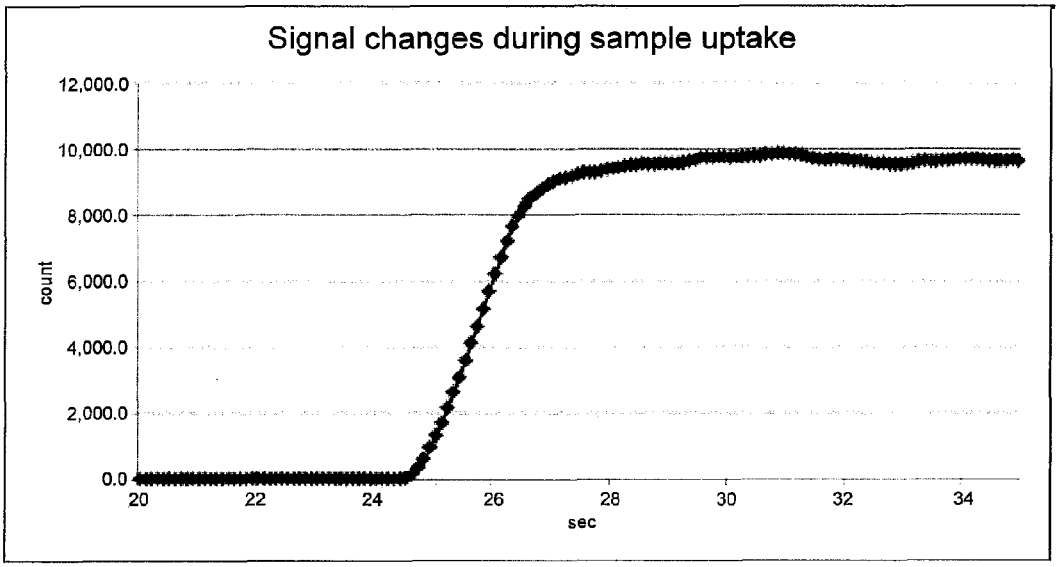
FIG. 3 is an exemplary graph showing signal changes for sample uptake.
Figure 4:
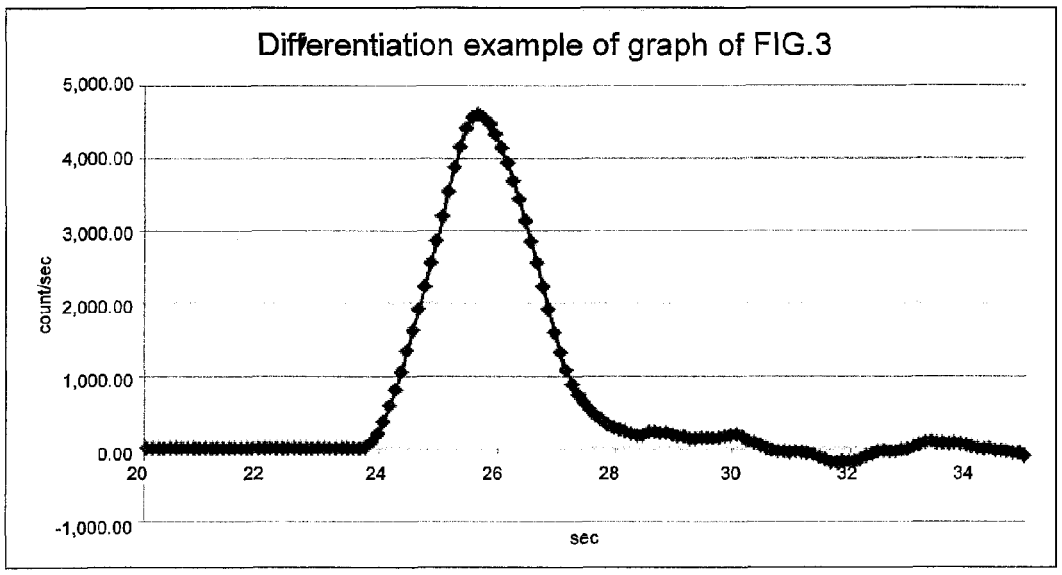
FIG. 4 is a graph showing a differential example of the graph of FIG. 3.
Figure 5:
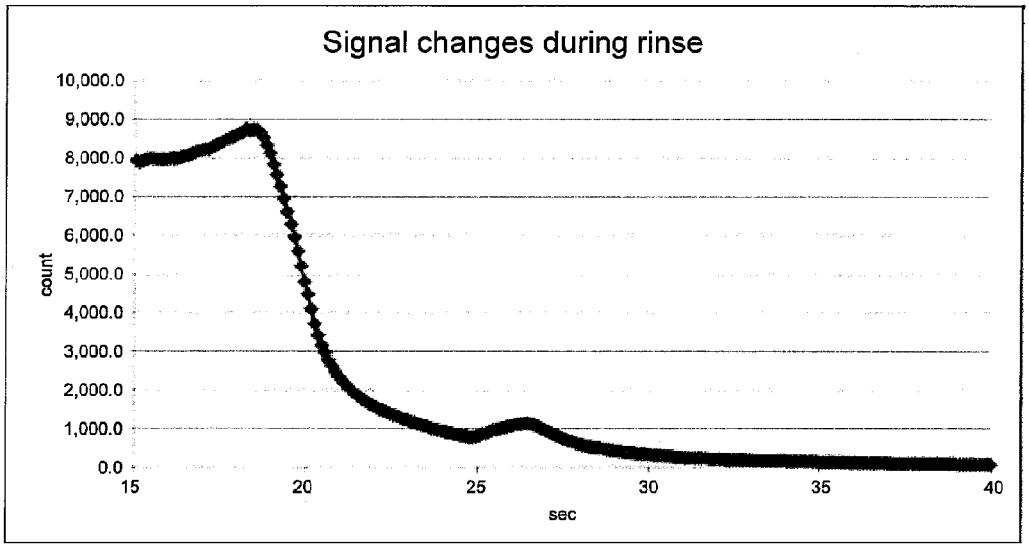
FIG. 5 is an exemplary graph showing signal changes for rinse.
Figure 6:
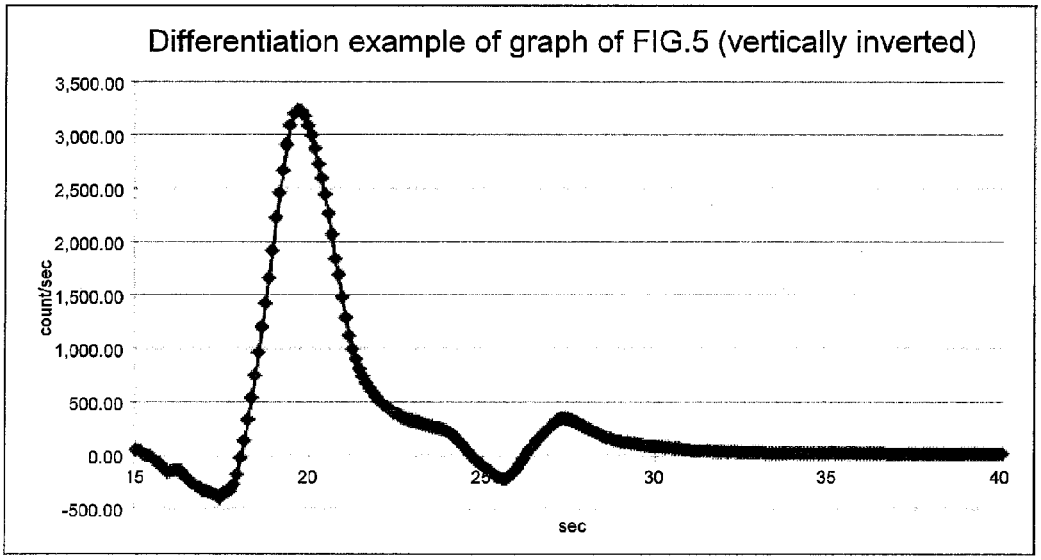
FIG. 6 is a graph showing a differential example of the graph of FIG. 5.

In FIG. 3 to FIG. 6, signal changes for the sample uptake and rinse, and graphs of differential values of these signal changes are exemplarily shown. FIG. 3 shows by graph that a standard solution is introduced into the plasma and measured and a moving-averaged signal increases. FIG. 4 is a differentiated example of the graph of FIG. 3, which indicates that zero crossing occurs 5 seconds after the detection of an extreme value. The replacement time may be obtained as a time period from the introduction of the standard solution to this zero crossing. Also, it may be obtained as a time period to the timing when the absolute value of the gradient becomes 15% or less of the absolute value of the extreme value in about 2 seconds after the detection of the extreme value. FIG. 5 is a graph obtained by moving-average of signal changes during rinse, and FIG. 6 indicates a vertical inversion of the gradient thereof. After the introduction of the rinse liquid, the measurement is conducted, a signal in a few seconds before the timing of detection of the extreme value as in FIG. 6 is estimated as a maximum value, and the timing when the signal is reduced to several percentage of the value can be estimated as an end of rinse. The estimated sample uptake time (replacement time) and rinse time may be included in the mass spectrometry method.

Semi-Quantitation of Sample to be Measured

Next, using the sample uptake time obtained as above, semi-quantitation of the sample to be measured is conducted. However, it is a matter of course that the semi-quantitation can be conducted by using an uptake time obtained by use of other standard or without using an uptake time. Semi-quantitation is rough quantitative determination of an element in the sample to be measured without using a standard substance. For example, the sensitivity characteristic of each element is preliminarily input and semi-quantitation is conducted by referring thereto. When it is desired to use a more accurate semi-quantitative value for a subsequent calculation, the sensitivity may be calibrated by conducting semi-quantitation by using, for example, a tuning liquid for an ICP mass spectrometry apparatus, a calibration standard liquid or a solution with a known element concentration. As indicated by S1 in FIG. 2, parameters, which are used for a created mass spectrometry method and pertain to an element as an object of measurement, are preliminary determined. These parameters may include a name of an element to be measured, and a name and a concentration of an element in an internal standard to be used. As a plasma condition used for semi-quantitation, a high matrix mode is preferably used considering the possibility that the concentration of an unknown sample is high. In order to semi-quantitate all elements that are contained in the sample to be measured and affect the determination on measurement conditions, scanning is conducted using all mass-to-charge ratios necessary for that semi-quantitation. This step is indicated as S3 in FIG. 2.

Selection of Plasma Condition

As being well-known, ionization of carrier gas is curbed in the case of a low-temperature plasma, and there are advantages such as a low background noise and an increase of the sensitivity to a light element. On the other side of the coin, there are drawbacks such as an increase of influence of a matrix effect in the case of a sample with a high matrix, and a difficulty in ionizing an element with a high ionization potential. In the present invention, concentrations of elements obtained by semi-quantitative measurement are totaled and a plasma condition is selected in response to the total concentration. In this case, the voltage of plasma and the amount of aerosol to be introduced can be controlled depending on the calculation result of the total concentration, but it is desirable to determine a plasma condition from several options preliminarily set depending on the total concentration. Even when it is selected from a limited number of options, it is considered that an error is small and no influence is exerted on a resultant setting value. As the options, modes from a low matrix mode to a high matrix mode set for several stages depending on the total concentration may be prepared. The setting may be made so that, for example, when the total concentration is about 2%, a high matrix mode is selected as the plasma condition; and when the total concentration is lower, a low matrix mode may be selected. However, it will be appreciated that these options can be set sequentially rather than discretely. Preliminarily-prepared options may be stored as a table in the computer memory, and a selected plasma condition is also stored. This step is indicated exemplarily as S4 in FIG. 2.

TABLE 1, provided as FIG. 7, schematically shows one example wherein the total of semi-quantitative concentrations is obtained based on the semi-quantitative results. TABLE 2 is one example showing the relationship in correspondence between the thus-obtained total of semi-quantitative concentrations and the plasma conditions. TABLE 3 is one example showing a selection of plasma mode based on the total of semi-quantitative concentrations.

TABLE 1

| Element | Mass number | Semi-quantitative conc. | Unit | CPS |
|---|---|---|---|---|
| Li | 7 | 0.065974892 | ppm | 1,170.0 |
| Be | 9 | 0.026581489 | ppm | 1,120.0 |
| B | 11 | 0.333197107 | ppm | 4,440.5 |
| C | 12 | 21.235864333 | ppm | 61,809.4 |
| [illegible] | [illegible] | [illegible]0.750427619 | ppm | 1,362,227.1 |
| [illegible] | [illegible] | [illegible] | [illegible] | 10,770,864.5 |
| [illegible] | [illegible] | [illegible] | [illegible] | [illegible] |
| Au | 197 | [illegible] | [illegible] | [illegible] |
| Hg | 202 | 0.000006866 | ppm | 100.0 |
| Tl | 205 | 0.006814349 | ppm | 407,750.3 |
| Pb | 208 | 0.018804081 | ppm | 755,384.4 |
| Bi | 209 | 0.013698305 | ppm | 808,211.4 |
| Th | 232 | 0.000020563 | ppm | 1,690.1 |
| U | 238 | 0.000002594 | ppm | 220.0 |

TABLE 2

| | Total of semi-quantitative concentrations | | | | | |
|---|---|---|---|---|---|---|
| | 0.0% | 0.1% | 0.2% | 0.5% | 1.0% | 3.0% |
| Plasma mode | Low matrix | General purpose | High matrix 1 | High matrix 2 | High matrix 3 | |

TABLE 3

| Total of semi-quantitative concentration | Determined plasma mode |
|---|---|
| 0.01% | Low matrix mode |

Estimation of Signal Strengths of Elements and Interference Components in Sample to be Measured According to the method of the present invention, for each of the elements detected by semi-quantitation of the sample, a signal indicative of each element and a signal indicative of an interference component are estimated based on the concentration obtained by the semi-quantitation. This is for obtaining estimate values for a signal of each element and a signal of an interference component on each plasma condition, each tuning condition used for a collision/reaction cell (e.g., non-gas mode, helium gas mode, high-energy helium gas mode and hydrogen gas mode), which are preliminarily prepared. However, in the case that a semi-quantitative result with sufficient accuracy cannot be obtained by a high matrix mode used for semi-quantitation, a plasma condition is changed and a semi-quantitation measurement may be conducted again, for example, in a low matrix mode.

Possible interference components include isobars of other elements, polyatomic (polymolecular) ions derived from other elements, and polyvalent ions of other elements. As ions interfering with a monovalent ion (M+) of each mass number, species such as M++, MO+, MH+, MAr+, MM+ and MOH+ are usually known. The generation rate of these interference ions is obtained by calculating a ratio between a signal of a sample with a preliminarily known concentration and a signal of interference ions generated therefrom. Then, the concentration of semi-quantitative mass-to-charge ratio, for example, CPS (counts per second) obtained as a detection signal is multiplied by the generation rate of these interference ions, thereby providing an estimate CPS value for each interference ion. Further, the kinds of isobar for elements of each mass number, and their isotope ratio are known, so the CPS of elements having isobars at the time of semi-quantitation is multiplied by the isotope ratio, thereby estimating the CPS of the isobar(s). Then, the total of interference ion CPS and isobar CPS is subtracted from an actually-measured semi-quantitative CPS on the mass-to-charge ratio, providing a CPS value for M+. The kind and generation ratio of interference ions, and the kind and isotope ratio of isobars are listed preliminarily for each element and stored as a table in a computer memory, and they may be referred to. In this way, an element concentration is estimated from signals estimated on an element and an interference component. These steps are indicated generally as S5 in FIG. 2.

TABLE 4 described below shows one example for, while taking aluminum as an example, estimating an interference component and based on that, estimating a CPS indicative of an element concentration. If Be, B, Mg, Cr, Fe and the like are measured together with Al by semi-quantitative measurement as shown in this example, the preliminarily-obtained generation rate of a specific isotope thereof, e.g., $BO^+$ as an interference ion based on B, is used to estimate an interference CPS of 3.6 by $BO^+$. Likewise, when the total of estimate values of interference signals from polyatomic ions or polyvalent ions is obtained on $^{27}Al$, it becomes 10. As a result, a signal indicative of a net concentration of $^{27}Al$ is estimated as 1070 (=1080-10).

TABLE 4

| Measured value of sample | | | | | Al-associated interference estimate | | |
|---|---|---|---|---|---|---|---|
| Atomic number | Element | Mass | Abundance ratio | Element ion $M^+$ CPS | Interference component | Mass-to charge ratio (m/z) | CPS |
| 13 | Al | 27 | 1.000 | 1080 | | | |
| 4 | Be | 9 | 1.000 | 1 | $BeO^+$ | 27 | 0.1 |
| 5 | B | 11 | 0.801 | 10860 | $BO^+$ | 27 | 3.6 |
| 12 | Mg | 24 | 0.790 | 441289 | $MgH^+$ | 27 | 6.1 |
| 24 | Cr | 52 | 0.838 | 5690 | $Cr^{++}$ | 27 | 0.0 |
| 26 | Fe | 56 | 0.918 | 32177 | $Fe^{++}$ | 27 | 0.2 |

A signal estimation for element and interference component having a tuning condition different from the tuning condition for a collision/reaction cell used for semi-quantitative measurement is carried out by converting a result estimated by semi-quantitation to other tuning condition. This conversion can be performed based on the ratio of semi-quantitative coefficients for each tuning condition, separately obtained preliminarily by using a single element sample or an admixture element sample and the ratio of interference ion generation rates. These ratios are also stored in, for example, a memory table of a computer. For example, when semi-quantitation is conducted in a helium gas mode, a conversion to other mode may be conducted by [CPS of a target element in a converted mode]=[CPS of the target element in a helium gas mode]×[Semi-quantitative coefficient of the target element in the converted mode]/[Semi-quantitative coefficient of the target element in the helium gas mode].

As described above, semi-quantitation is preferably conducted in a high matrix mode. However, if the selected plasma mode is different, semi-quantitation can be conducted again using the selected plasma mode. However, when sufficient signal counts on an element to be measured are obtained, signal strength estimation on element and interference component obtained in a high matrix mode can be converted to signal strengths on element and interference component under the selected plasma mode. Whether sufficient signal counts are obtained or not can be determined based on the standard where, for example, [signals of an element to be measured in a blank solution]/[signals of the element to be measured in a sample] is not greater than a predetermined threshold and [signal counts of the element to be measured in the sample] is not less than a predetermined value. For example, when sufficient signal counts are not obtained, a plasma condition for semi-quantitative measurement is changed (S8) based on the determination at Step S6 in FIG. 2 and semi-quantitation is conducted again. It will be noted that the order of Steps S5 and S6 may be changed.

TABLE 5 described below shows one example indicating the way of converting no-gas mode, high-energy helium gas mode (HEHe) and hydrogen gas mode ($H_2$) by using semi-quantitative coefficient ratio obtained for each matrix mode in the case that the semi-quantitation in TABLE 4 is conducted in helium gas mode.

TABLE 5

| | Semi-quantitative coefficient in low matrix mode | | | | CPS-converted value in each tune mode | | | |
|---|---|---|---|---|---|---|---|---|
| Element | No gas | He | HEHe | $H_2$ | No gas | He | HEHe | $H_2$ |
| Al | 76626 | 664 | 518 | 3148 | 123568 | 1070 | 835 | 5076 |

Selection of Internal Standard

A mass spectrometry method determined on a sample to be measured may include a selected internal standard (ISTD). This is for selecting a combination of elements suitable for quantitative value correction of the sample to be measured on elements to be used as internal standard in mass spectrometry, such as Li, Sc, Ge, Y, Rh and In. These elements may be automatically introduced preliminarily in the sample to be measured for the purpose of using them as an internal standard. For example, the priority index for each element is obtained, first to fourth elements from the lowest index are selected, and a combination of elements usable as the internal standard can be determined. The priority index for a certain element, for example, may be set based on at least one of a first ionization energy difference, a mass number difference, the identity or the characteristic similarity in the group of the periodic table, a boiling point difference and experimental rule between this element and the analyte element. The procedure for determining the priority order may be programmed and executed by a computer in carrying out the method of the present invention.

Next, regarding the element or element combination thus obtained and defined, it is determined: whether to contain an element having a mass-to-charge ratio overlapping that of the analyte element in the sample to be measured; and the content of the internal standard element in the sample to be measured estimated by semi-quantitation is not greater than a predetermined reference value and at a negligible level relative to the concentration of the internal standard element after mixing. The term "negligible level" used herein means a case wherein an error given to a final analytical result is not greater than a predetermined threshold. When the overlapping with the analyte element or the content not less than the reference value is determined, the same determination procedure will be repeated on the next candidate element or element combination. Regarding the element combination used as the internal standard, selectable combinations are stored in advance in a memory table, and the above determination may be made on these combinations. When no optimum combination is found, a combination causing the smallest error is selected. These steps are indicated as S9 in FIG. 2. Exemplary combinations of internal standards are shown in TABLE 6.

TABLE 6

| Element | m/z | ISTD 1 | ISTD 2 | ISTD 3 | ISTD 4 | m/z 1 | m/z 2 | m/z 3 | m/z 4 |
|---|---|---|---|---|---|---|---|---|---|
| Li | 7 | $^6Li$ | Sc | Ge | In | 6 | 45 | 72 | 115 |
| Be | 9 | $^6Li$ | Sc | Ge | In | 6 | 45 | 72 | 115 |
| B | 11 | $^6Li$ | Sc | Ge | In | 6 | 45 | 72 | 115 |
| C | 12 | $^6Li$ | Sc | Ge | In | 6 | 45 | 72 | 115 |
| N | 14 | $^6Li$ | Sc | Ga | In | 6 | 45 | 72 | 115 |
| Na | 23 | $^6Li$ | Sc | Ge | In | 6 | 45 | 72 | 115 |
| Mg | 24 | $^6Li$ | Sc | Ge | In | 6 | 45 | 72 | 115 |
| Al | 27 | $^6Li$ | Sc | Ge | In | 6 | 45 | 72 | 115 |
| Si | 28 | Sc | Ge | $^6Li$ | In | 45 | 72 | 6 | 115 |
| P | 31 | Sc | $^6Li$ | Ge | In | 45 | 6 | 72 | 115 |
| S | 34 | Sc | Ge | $^6Li$ | In | 45 | 72 | 6 | 115 |
| Cl | 35 | Sc | Ge | $^6Li$ | In | 45 | 72 | 6 | 115 |
| K | | | | | In | 45 | 6 | 72 | 115 |
| | | | | | | 45 | 6 | 72 | 1 |

Selection of Mass-to-Charge Ratio

A mass spectrometry method used for a sample to be measured may designate a mass-to-charge ratio for measuring an analyte element. A mass-to-charge (m/z) is usually assumed on a monovalent ion $M^+$. However, in the case of measuring polyatomic ions generated by intentional reaction with hydrogen, oxygen, ammonia or the like, a mass-to-charge ratio of these polyatomic ions or polyvalent ions derived from the element to be measured is to be used. Regarding the mass-to-charge ratio, the priority order for each analyte element is determined, and it is favorable to make selection in accordance with the priority order. However, there are some cases where prioritization is not necessary, such as a case where the number of selectable mass-to-charge ratios is limited. It is preferable to determine the priority order for each element in advance, considering the isotope abundance ratio for the element, the possibility to cause overlapping with isobars, experimental rules and the like, and to store in a memory table (mass-to-charge table). Regarding Cd, for example, the priority may be set in the order of mass-to-charge ratios of 111, 114 and 112. Then, regarding a selected mass-to-charge ratio, evaluation may be made when such mass-to-charge ratio is used. The evaluation may be made based on whether an error estimated on the mass-to-charge ratio is not greater than a predetermined threshold on the basis of signal strengths of element and interference component estimated for the analyte element. However, further consideration on the integration time, blank noise or the like allows stricter determination. Estimation on an error can be made by using an evaluation function, and the evaluation function may be, for example, at least one of: an estimation value of interference signal estimated for the mass-to-charge ratio; and an estimation value of detection limit. As one example, a threshold for evaluation is [threshold]=MAX ([semi-quantitative concentration]×[Expected RSD %], [Expected quantity lower limit]), the determination of mass-to-charge ratio is obtained by [Detection limit estimation value]+[Interference concentration conversion value]≤[Threshold]. This allows a mass-to-charge ratio suitable for each tuning condition to be selected. If an optimum mass-to-charge ratio is not obtained, a first priority mass-to-charge ratio or a mass-to-charge ratio causing the smallest error is selected.

Selection of Tuning Condition for Collision/Reaction Cell

A mass spectrometry method determined on a sample to be measured may include a tuning condition (mode) selected for a collision/reaction cell. In this case, tuning modes are prioritized for each analyte element considering the easiness of measurement, and they may be stored in a memory table so that selection can be made from the first one in the priority order. For example, for analysis by an apparatus including a hydrogen gas option, a hydrogen gas mode is preferably selected. In the case of excluding a hydrogen gas option or reducing a measurement time, a helium gas mode is preferably selected. However, it is a matter of course that a tuning condition can be selected without using such prioritization, and a tuning condition can be created without using options, but preparation of a small number of options is advantageous to reduce the number of conditions or the calculation amount to be considered for determining setting values. Also, in the case of discrete options, numeral values are rounded off. Thus, even when there is an error within the same round-off range for numeral values, the same setting value is adopted and selection mistakes are less likely to occur. TABLE 7 shows one example on the priority order of tune modes for aluminum determined in the above manner.

TABLE 7

| Element | m/z | #1 | #2 | #3 | #4 |
|---|---|---|---|---|---|
| Al | 27 | No Gas | He | $H_2$ | HEHe |

Once a tuning condition is selected, whether an error estimated for the tuning condition is not greater than a predetermined threshold can be determined based on the signal strengths of element and interference component estimated for an analyte element by using the previously determined mass-to-charge ratio together. The determination can be made based on whether an error estimated for the tuning condition is not greater than a predetermined threshold on the basis of the signal strengths of element and interference component estimated for an analyte element. However, like the case for estimating a mass-to-charge ratio, further consideration on the integration time, blank noise or the like allows stricter determination. Estimation on an error can be made by using an evaluation function, and the evaluation function may be, for example, at least one of: an estimation value of interference signal estimated for the mass-to-charge ratio; and an estimation value of detection limit. Specific evaluation and determination can be made in the same manner as in the case for estimation of mass-to-charge ratio described above. If the determination result is negative, a tuning condition with second high priority is selected. If the estimation value on error is not lower the threshold even when the last priority is used, the first priority tuning condition or the tuning condition with the smallest error estimation can be used. Conventionally, such determination on measurement conditions are made by actually measuring a sample in a plurality of tune modes by use of experimentally-adopted mass-to-charge ratios and based on that result, selecting a suitable measurement condition. However, according to the present invention, conditions are sequentially selected based on the semi-quantitation, and thereby a suitable mass spectrometry method can be established without repeating actual measurements. Section step of tuning conditions and mass-to-charge ratios is indicated as S7 in FIG. 2. It should be noted that the execution order of S7, S9 and S10 is not limited, and it may be modified appropriately according to circumstances.

TABLE 8 shows an example for calculating error estimation for each tuning condition while taking aluminum as an example as described above. The threshold is 0.3, so the first priority, the No Gas mode is selected when the priority order is one shown in TABLE 7.

TABLE 8

| Element | | Al | | |
|---|---|---|---|---|
| m/z | | 27.0 | | |
| Abundance ratio | | 1.0 | | |
| Plasma mode | No Gas | He | HEHe | $H_2$ |
| $M^+$ CPS estimation value | 202005.2 | 1069.0 | 724.3 | 2259.6 |
| Interference component CPS estimation value | 1993.1 | 10.0 | 2.1 | 30.2 |
| Error estimation value calculated from blank CPS | 0.0 | 0.0 | 0.0 | 0.0 |
| ppb-converted value for error total estimation | 0.04 | 0.04 | 0.01 | 0.06 |
| Threshold | | 0.3 | | |

Selection of Integration Time

A mass spectrometry method determined on a sample to be measured may include an integration time of an analyte element in a mass spectrometer. The integration time can be calculated by a semi-quantitative measurement result and an input of a user, or a target count resulting from an input value, but it may be configured to be selected by narrowing down several options. For example, the integration time may be configured to be selected from discrete values such as 0.1, 0.3, 1, 3 and 10 seconds. These options may be also stored in a memory table.

When the integration time is obtained by calculation, the integration time can be obtained from a measurement target value per one sample based on, for example, a standard deviation for a blank sample, an element concentration estimated for the sample to be measured, a CPS value, an expected quantitative lower limit value or the like. More specifically, in accordance with a selected mode for measurement condition, a count number of target is calculated at the time of measurement, an integration time for each mass-to-charge ratio is calculated, and the total of integration times are calculated. These may be easily implemented by software. When the total of integration times exceeds the target value, an integration time may be reduced depending on the selected mode for measurement condition. When the selected plasma mode or tuning condition for collision/reaction cell is the same as for semi-quantitative measurement, the integration time may be determined using an actual measured value of CPS. Selection step of integration time is indicated as S10 in FIG. 2. TABLE 9 shows an example for obtaining an integration time for each of several elements.

TABLE 9

| Target count 1000 | | | | |
|---|---|---|---|---|
| | Element | | | |
| | Mg | Al | Cr | Fe |
| CPS estimation value of element conc. | 441289 | 1080 | 5690 | 32177 |
| Target count/CPS [s] | 0.002 | 0.926 | 0.176 | 0.031 |
| Integration time after round-off [s] | 0.1 | 1.0 | 0.3 | 0.1 |

Implementation of Mass Spectrometry

As described above, the present invention creates at least one mass spectrometry method including at least one of a plasma condition, an internal standard to be added to a sample to be measured, a tuning condition for collision/reaction cell, a mass-to-charge ratio used for a mass spectrometer, and an integration time used for a mass spectrometer, on the basis of signal strength of an element and an interference component in the sample, and an element concentration, which are estimated for each of semi-quantitated elements. The mass spectrometry method preferably includes all of an internal standard, a tuning condition, a mass-to-charge ratio and an integration time. Further, the mass spectrometry method may include a sample uptake time and a rinse time determined before semi-quantitation.

The created mass spectrometry method is next used to conduct a quantitative analysis in an ICP mass spectrometry apparatus in order to quantitate the sample to be measured, that is obtain a desired measured value for an analyte element. This can be carried out, for example, by preparing the created mass spectrometry method as a batch file and executing it on a computer.

DESCRIPTION OF REFERENCE NUMERALS

100 ICP mass spectrometry apparatus
110 Sample uptake section
120 Sample introduction section
130 Inductively coupled plasma ion source
140 Interface
150 Ion lens
160 Collision/reaction cell
170 Mass filter
180 Detector It will be understood that various aspects or details of the invention may be changed without departing from the scope of the invention. Furthermore, the foregoing description is for the purpose of illustration only, and not for the purpose of limitation—the invention being defined by the claims.

What is claimed is:

1. In a plasma ion source mass spectrometry apparatus wherein a sample to be measured is supplied into plasma to ionize elements in the sample, a beam of the generated ions is introduced into a mass spectrometer through a collision/reaction cell, and ionized elements are separated and detected according to mass-to-charge ratio, a process for automatically creating a mass spectrometry method, the process comprising the steps of:

semi-quantitatively measuring at least all elements in the sample that affect the setting of measurement conditions;

determining a plasma condition based on the total concentration of the semi-quantitatively measured elements;

for each of the semi-quantitatively measured elements, estimating signal strengths of the element and interference components in the sample and, based on the resultant estimates, estimating the concentration of the element; and based on the estimated signal strengths of the elements and the interference components and the estimated concentrations of the elements, creating at least one mass spectrometry method including at least one of:

(1) a plasma condition;

(2) a combination of internal standard elements used for correction at the time of quantitating an element to be measured;

(3) a tuning condition for the collision/reaction cell;

(4) a mass-to-charge ratio used in a mass spectrometer; and (5) an integration time used in the mass spectrometer.

2. The process according to claim 1, wherein a liquid sample or a gaseous sample is introduced into the plasma ion source mass spectrometry apparatus prior to semi-quantitatively measuring the all elements in the sample, a detection signal is measured and differentiated to detect an extreme value of a gradient, after which a detection is made when the gradient approaches 0, thereby estimating an uptake time of the sample to the plasma and/or a washing time of the introduction path with a rinse liquid and incorporating them into the mass spectrometry method.

3. The process according to claim 2, wherein the uptake time/washing time are estimated after removing noises from the detection signal of the sample, prior to estimating the uptake time of the sample and/or the washing time of the introduction path with a rinse liquid.

4. The process according to claim 1, wherein the plasma condition is determined by selecting from a plurality of previously-defined discrete plasma conditions or continuous plasma conditions.

5. The process according to claim 1, wherein, for each of the semi-quantitatively measured elements, the signal strength of the interference components is estimated by using the species and a generation ratio of at least one of interference ions attributable to other elements measured simultaneously, and/or isobars and isotope ratios of the simultaneously-measured other elements.

6. The process according to claim 1, wherein the concentration of each of the semi-quantitatively measured elements in the sample is estimated by subtracting the estimated signal strength of the interference components from a semi-quantitatively measured signal strength.

7. The process according to claim 1, wherein the plasma condition is re-determined based on the estimated concentration of the element in the sample.

8. The process according to claim 1, wherein the semi-quantitative measurement is conducted again using the determined plasma condition.

9. The process according to claim 1, wherein a plurality of candidates of a combination of an analyte element and internal standard elements are defined in advance, and the internal standard is selected from the candidates in such a manner that elements having the same mass-to-charge ratio as the analyte element in the sample are excluded and elements used as the internal standard are present in the sample in amounts not greater than a predetermined threshold and an error influencing a final analysis result caused by the concentration of the internal standard elements after mixing is not greater than a predetermined threshold.

10. The process according to claim 9, wherein the plurality of combinations of elements are determined based on at least one of a first ionization energy difference, a mass number difference, the sameness of the group in the periodic table or similarity of properties, and a boiling point difference between the analyte element and the internal standard elements, as well as experimental rules.

11. The process according to claim 1, wherein the tuning condition for the collision/reaction cell is selected from a plurality of previously-selected tuning conditions based on whether an evaluation function is not greater than a predetermined determination threshold, the evaluation function including at least one of an estimated value of the interference signal estimated for the tuning condition based on the signal strengths of the elements and the interference components estimated for the analyte element and an estimated detection limit value.

12. The process according to claim 11, wherein the plurality of tuning conditions include at least one of a non-gas mode, a helium gas mode, a high-energy helium gas mode and a hydrogen gas mode.

13. The process according to claim 1, wherein the mass-to-charge ratio used in the mass spectrometer is selected from a mass-to-charge ratio table having prioritized mass-to-charge ratios for respective elements, based on whether an evaluation function is not greater than a predetermined determination threshold, the evaluation function including at least one of an estimated value of the interference signal estimated for the mass-to-charge ratio based on the signal strengths of the elements and the interference components estimated for the analyte element and an estimated detection limit value.

14. The process according to claim 13, wherein the mass-to-charge ratio table is created based on an isotope abundance ratio, an isobaric overlapping possibility and/or experimental rules.

15. The process according to claim 1, wherein the integration time is determined using the estimated element concentration or an estimated CPS (count per second) value, or an actual measured value.

16. The process according to claim 1, wherein the semi-quantitative measurement includes calibrating the sensitivity using a tuning solution for the plasma ion source mass spectrometry apparatus, a calibration standard solution or a solution of a known element concentration.

17. The process according to claim 1, wherein the plasma ion source mass spectrometry apparatus is an ICP mass spectrometry apparatus.

18. The process according to claim 1, wherein the process is implemented by a non-transitory computer program.

19. In a plasma ion source mass spectrometry apparatus wherein a sample to be measured is supplied into plasma to ionize elements in the sample, a beam of the generated ions is introduced into a mass spectrometer through a collision/reaction cell, and ionized elements are separated and detected according to mass-to-charge ratio, a non-transitory computer program for automatically creating a mass spectrometry method used for operating the plasma ion source mass spectrometry apparatus, the computer program enabling a computer to execute:

a procedure for semi-quantitatively measuring at least all elements in the sample that affect the setting of measurement conditions, using the plasma ion source mass spectrometry apparatus;

a procedure for determining a plasma condition based on the total concentration of the semi-quantitatively measured elements;

a procedure for estimating, for each of the semi-quantitatively measured elements, signal strengths of the element and interference components in the sample and, based on the resultant estimates, estimating the concentration of the element; and a procedure for, based on the estimated signal strengths of the elements and the interference components and the estimated element concentration, determining at least one mass spectrometry method including at least one of:

(1) a plasma condition;

(2) a combination of internal standard elements used for correction at the time of quantitating an element to be measured;

(3) a tuning condition for the collision/reaction cell;

(4) a mass-to-charge ratio used in a mass spectrometer; and (5) an integration time used in the mass spectrometer.

20. The program according to claim 19, wherein, prior to semi-quantitatively measuring all elements in the sample, the program enables the computer to execute a procedure for introducing a liquid sample or a gaseous sample into the plasma ion source mass spectrometry apparatus and measuring a detection signal, and a procedure for differentiating the measured value to detect an extreme value of a gradient and thereafter detecting when the gradient approaches 0, thereby estimating an uptake time of the sample to the plasma and/or a washing time of the introduction path with a rinse liquid.

* * * * *